US009881625B2

(12) United States Patent
Liu et al.

(10) Patent No.: US 9,881,625 B2
(45) Date of Patent: Jan. 30, 2018

(54) DEVICE AND METHOD FOR EXECUTION OF HUFFMAN CODING

(75) Inventors: Zongxian Liu, Singapore (SG); Kok Seng Chong, Singapore (SG); Masahiro Oshikiri, Kanagawa (JP)

(73) Assignee: PANASONIC INTELLECTUAL PROPERTY CORPORATION OF AMERICA, Torrance, CA (US)

( * ) Notice: Subject to any disclaimer, the term of this patent is extended or adjusted under 35 U.S.C. 154(b) by 162 days.

(21) Appl. No.: 14/008,732

(22) PCT Filed: Mar. 12, 2012

(86) PCT No.: PCT/JP2012/001701
§ 371 (c)(1),
(2), (4) Date: Sep. 30, 2013

(87) PCT Pub. No.: WO2012/144127
PCT Pub. Date: Oct. 26, 2012

(65) Prior Publication Data

US 2014/0114651 A1 Apr. 24, 2014

(30) Foreign Application Priority Data

Apr. 20, 2011 (JP) ..... 2011-094295
Jun. 15, 2011 (JP) ..... 2011-133432

(51) Int. Cl.
*G10L 19/032* (2013.01)
*G10L 19/02* (2013.01)
*G10L 19/00* (2013.01)

(52) U.S. Cl.
CPC ..... *G10L 19/032* (2013.01); *G10L 19/0017* (2013.01); *G10L 19/0208* (2013.01); *G10L 19/0212* (2013.01)

(58) Field of Classification Search
CPC ..... G10L 19/032; G10L 19/0212
(Continued)

(56) References Cited

U.S. PATENT DOCUMENTS 5,848,195 A 12/1998 Romriell
6,411,226 B1 * 6/2002 Law ..... H03M 7/40 341/65
(Continued)

FOREIGN PATENT DOCUMENTS

JP 07-261800 10/1995
JP 2002-268693 9/2002
(Continued)

OTHER PUBLICATIONS

ITU-T Telecommunication Standardization Sector of ITU, Series G: Transmission Systems and Media, Digital Systems and Networks, Digital terminal equipments—Coding of analogue signals, "Low-complexity, full-band audio coding for high-quality, conversational applications", Recommendation ITU-T G.719, Jun. 2008.
(Continued)

*Primary Examiner* — Paras D Shah
*Assistant Examiner* — Bryan Blankenagel
(74) *Attorney, Agent, or Firm* — Greenblum & Bernstein, P.L.C.

(57) ABSTRACT

In this invention, the design of the Huffman table can be done offline with a large input sequence database. The range of the quantization indices (or differential indices) for Huffman coding is identified. For each value of range, all the input signal which have the same range will be gathered and the probability distribution of each value of the quantization indices (or differential indices) within the range is calculated. For each value of range, one Huffman table is designed according to the probability. And in order to improve the bits efficiency of the Huffman coding, apparatus and methods to reduce the range of the quantization indices (or differential indices) are also introduced.

6 Claims, 10 Drawing Sheets

(58) Field of Classification Search
USPC ..... 704/501
See application file for complete search history.

(56) References Cited

U.S. PATENT DOCUMENTS

| | | | | |
|---|---|---|---|---|
| 7,668,715 | B1 | 2/2010 | Chaugule et al. | |
| 2002/0021754 | A1* | 2/2002 | Pian | H04N 19/176 375/240.02 |
| 2003/0112979 | A1* | 6/2003 | Toyama | G10L 19/0208 381/23 |
| 2004/0120404 | A1* | 6/2004 | Sugahara | G10L 19/24 375/240.23 |
| 2005/0114123 | A1* | 5/2005 | Lukac | G10L 19/10 704/222 |
| 2006/0074693 | A1 | 4/2006 | Yamashita | |
| 2008/0046233 | A1* | 2/2008 | Chen | G10L 19/005 704/211 |
| 2008/0097749 | A1* | 4/2008 | Xie et al. | 704/200.1 |
| 2008/0097755 | A1* | 4/2008 | Xie | 704/222 |
| 2009/0030678 | A1* | 1/2009 | Kovesi et al. | 704/230 |
| 2009/0129284 | A1* | 5/2009 | Jung | H04W 72/1231 370/252 |
| 2011/0028215 | A1* | 2/2011 | Herr | G10L 19/00 463/35 |

FOREIGN PATENT DOCUMENTS

| | | |
|---|---|---|
| JP | 2003-233397 | 8/2003 |
| JP | 2004-246224 | 9/2004 |
| JP | 2008-032823 | 2/2008 |
| WO | 2005/004113 | 1/2005 |

OTHER PUBLICATIONS

International Search Report, dated Apr. 24, 2012, for corresponding International Application No. PCT/JP2012/001701.

Extended European Search Report, dated Feb. 24, 2014, from European Patent Office (E.P.O.), for the corresponding European Patent Application.

* cited by examiner

| Index | Code | Index | Code | Index | Code | Index | Code |
|---|---|---|---|---|---|---|---|
| 0 | $2^{17.0}$ | 10 | $2^{12.0}$ | 20 | $2^{7.0}$ | 30 | $2^{2.0}$ |
| 1 | $2^{16.5}$ | 11 | $2^{11.5}$ | 21 | $2^{6.5}$ | 31 | $2^{1.5}$ |
| 2 | $2^{16.0}$ | 12 | $2^{11.0}$ | 22 | $2^{6.0}$ | 32 | $2^{1.0}$ |
| 3 | $2^{15.5}$ | 13 | $2^{10.5}$ | 23 | $2^{5.5}$ | 33 | $2^{0.5}$ |
| 4 | $2^{15.0}$ | 14 | $2^{10.0}$ | 24 | $2^{5.0}$ | 34 | $2^{0.0}$ |
| 5 | $2^{14.5}$ | 15 | $2^{9.5}$ | 25 | $2^{4.5}$ | 35 | $2^{-0.5}$ |
| 6 | $2^{14.0}$ | 16 | $2^{9.0}$ | 26 | $2^{4.0}$ | 36 | $2^{-1.0}$ |
| 7 | $2^{13.5}$ | 17 | $2^{8.5}$ | 27 | $2^{3.5}$ | 37 | $2^{-1.5}$ |
| 8 | $2^{13.0}$ | 18 | $2^{8.0}$ | 28 | $2^{3.0}$ | 38 | $2^{-2.0}$ |
| 9 | $2^{12.5}$ | 19 | $2^{7.5}$ | 29 | $2^{2.5}$ | 39 | $2^{-2.5}$ |

FIG. 2

| Index | Code | Index | Code | Index | Code | Index | Code |
|---|---|---|---|---|---|---|---|
| 0 | 0011010 | 8 | 001100 | 16 | 000 | 24 | 0011110 |
| 1 | 0111010 | 9 | 011100 | 17 | 010 | 25 | 0111110 |
| 2 | 1011010 | 10 | 101100 | 18 | 1010 | 26 | 1011110 |
| 3 | 1111010 | 11 | 111100 | 19 | 1110 | 27 | 1111110 |
| 4 | 0011011 | 12 | 0010 | 20 | 001110 | 28 | 0011111 |
| 5 | 0111011 | 13 | 0110 | 21 | 011110 | 29 | 0111111 |
| 6 | 1011011 | 14 | 100 | 22 | 101110 | 30 | 1011111 |
| 7 | 1111011 | 15 | 110 | 23 | 111110 | 31 | 1111111 |

Table 6.1

| Flag | Huffman table range |
|---|---|
| 00 | 13-17 |
| 01 | 12-18 |
| 10 | 11-19 |
| 11 | 10-20 |

Table 6.2

| Index | Code |
|---|---|
| 13 | 110 |
| 14 | 00 |
| 15 | 01 |
| 16 | 10 |
| 17 | 111 |

Table 6.3

| Index | Code |
|---|---|
| 12 | 1100 |
| 13 | 1101 |
| 14 | 01 |
| 15 | 00 |
| 16 | 10 |
| 17 | 1110 |
| 18 | 1111 |

Table 6.4

| Index | Code |
|---|---|
| 11 | 0110 |
| 12 | 1110 |
| 13 | 1100 |
| 14 | 10 |
| 15 | 00 |
| 16 | 010 |
| 17 | 1101 |
| 18 | 1111 |
| 19 | 0111 |

Table 6.5

| Index | Code |
|---|---|
| 10 | 1010 |
| 11 | 0110 |
| 12 | 1110 |
| 13 | 1100 |
| 14 | 100 |
| 15 | 00 |
| 16 | 010 |
| 17 | 1101 |
| 18 | 1111 |
| 19 | 0111 |
| 20 | 1011 |

FIG. 6B

DEVICE AND METHOD FOR EXECUTION OF HUFFMAN CODING

TECHNICAL FIELD

The present invention relates to an audio/speech encoding apparatus, audio/speech decoding apparatus and audio/speech encoding and decoding methods using Huffman coding.

BACKGROUND ART

In signal compression, Huffman coding is widely used to encode an input signal utilizing a variable-length (VL) code table (Huffman table). Huffman coding is more efficient than fixed-length (FL) coding for the input signal which has a statistical distribution that is not uniform.

In Huffman coding, the Huffman table is derived in a particular way based on the estimated probability of occurrence for each possible value of the input signal. During encoding, each input signal value is mapped to a particular variable length code in the Huffman table.

By encoding signal values that are statistically more likely to occur using relatively short VL codes (using relatively few bits), and conversely encoding signal values that are statistically infrequently to occur using relatively long VL codes (using relatively more bits), the total number of bits used to encode the input signal can be reduced.

CITATION LIST

[Non-patent document 1] ITU-T Recommendation G.719 (06/2008)
"Low-complexity, full-band audio coding for high-quality, conversational applications"

SUMMARY OF INVENTION

Technical Problem

However, in some applications, such as audio signal encoding, the signal statistics may vary significantly from one set of audio signal to another set of audio signal. And even within the same set of audio signal.

If the statistics of the audio signal varies drastically from the statistics of the predefined Huffman table, the encoding of the signal can not be optimally done. And it happens that, to encode the audio signal which has different statistics, the bits consumption by Huffman coding is much more than the bits consumption by fixed length coding.

One possible solution is to include both the Huffman coding and fixed length coding in the encoding, and the encoding method which consumes fewer bits are selected. One flag signal is transmitted to decoder side to indicate which coding method is selected in encoder. This solution is utilized in a newly standardized ITU-T speech codec 0.719.

The solution solves the problem for some very extreme sequences in which the Huffman coding consumes more bits than the fixed length coding. But for other input signals which have different statistics from the Huffman table but still select the Huffman coding, it is still not optimal.

In ITU-T standardized speech codec G.719, Huffman coding is used in encoding of the norm factors' quantization indices.

The structure of G.719 is illustrated in FIG. 1.

At encoder side, the input signal sampled at 48 kHz is processed through a transient detector (101). Depending on the detection of a transient, a high frequency resolution or a low frequency resolution transform (102) is applied on the input signal frame. The obtained spectral coefficients are grouped into bands of unequal lengths. The noun of each band is estimated (103) and resulting spectral envelope consisting of the norms of all bands is quantized and encoded (104). The coefficients are then normalized by the quantized norms (105). The quantized norms are further adjusted (106) based on adaptive spectral weighting and used as input for bit allocation (107). The normalized spectral coefficients are lattice-vector quantized and encoded (108) based on the allocated bits for each frequency band. The level of the non-coded spectral coefficients is estimated, coded (109) and transmitted to the decoder. Huffman encoding is applied to quantization indices for both the coded spectral coefficients as well as the encoded norms.

At decoder side, the transient flag is first decoded which indicates the frame configuration, i.e., stationary or transient. The spectral envelope is decoded and the same, bit-exact, norm adjustments and bit-allocation algorithms are used at the decoder to recompute the bit-allocation which is essential for decoding quantization indices of the normalized transform coefficients. After de-quantization (112), low frequency non-coded spectral coefficients (allocated zero bits) are regenerated by using a spectral-fill codebook built from the received spectral coefficients (spectral coefficients with non-zero bit allocation) (113). Noise level adjustment index is used to adjust the level of the regenerated coefficients. High frequency non-coded spectral coefficients are regenerated using bandwidth extension. The decoded spectral coefficients and regenerated spectral coefficients are mixed and lead to normalized spectrum. The decoded spectral envelope is applied leading to the decoded full-band spectrum (114). Finally, the inverse transform (115) is applied to recover the time-domain decoded signal. This is performed by applying either the inverse modified discrete cosine transform for stationary modes, or the inverse of the higher temporal resolution transform for transient mode.

In encoder (104), the norm factors of the spectral sub bands are scalar quantized with a uniform logarithmic scalar quantizer with 40 steps of 3 dB. The codebook entries of the logarithmic quantizer are shown in FIG. 2. As seen in the codebook, the range of the norm factors is $[2^{-2.5},2^{17}]$, and the value decreases as the index increases.

The encoding of quantization indices for norm factors is illustrated in FIG. 3. There are in total 44 sub bands and correspondingly, 44 norm factors. For the first sub band, the norm factor is quantized using the first 32 codebook entries (301), while other norm factors are scalar quantized with the 40 codebook entries (302) shown in FIG. 2. The quantization index for the first sub band norm factor is directly encoded with 5 bits (303), while the indices for other sub bands are encoded by differential coding. The differential indices are derived using the formula as following (304):

[1]

$$\text{Diff_index}(n)=\text{Index}(n)-\text{Index}(n-1)+15 \text{ for } n\in[1,43] \quad \text{(Equation 1)}$$

And the differential indices are encoded by two possible methods, fixed length coding (305) and Huffman coding (306). The Huffman table for the differential indices is shown in FIG. 4. In this table, there are in total 32 entries, from 0 to 31, which caters for possibilities of abrupt energy change between neighboring sub bands.

However, for an audio input signal, there is a physical phenomenon named as auditory masking. Auditory masking occurs when the perception of one sound is affected by the presence of another sound. As example, if there are two signals with similar frequencies existing at the same time: one powerful spike at 1 kHz and one lower-level tone at 1.1 kHz, the lower-level tone at 1.1 kHz will be masked (inaudible) due to existence of the powerful spike at 1 kHz.

The sound pressure level needed to make the sound perceptible in the presence of another sound (masker), is defined as masking threshold in audio encoding. The masking threshold depends upon the frequency, the sound pressure level of the masker. If the two sounds have similar frequency, the masking effect is large, and the masking threshold is also large. If the masker has large sound pressure level, it has strong masking effect on the other sound, and the masking threshold is also large.

According to the auditory masking theory above, if one sub band has very large energy, it would have large masking effect on other sub bands, especially on its neighboring sub bands. Then the masking threshold for other sub bands, especially the neighboring sub band, is large.

If the sound component in the neighboring sub band has small quantization errors (less than the masking threshold), the degradation on sound component in this sub band is not able to be perceived by the listeners.

It is not necessary to encode the normal factor with very high resolution for this sub band as long as the quantization errors below the masked threshold.

Solution to Problem

In this invention, apparatus and methods exploring audio signal properties for generating Huffman tables and for selecting Huffman tables from a set of predefined tables during audio signal encoding are provided.

Briefly, the auditory masking properties are explored to narrow down the range of the differential indices, so that a Huffman table which have fewer code words can be designed and used for encoding. As the Huffman table has fewer code words, it is possible to design the code codes with shorter length (consumes fewer bits). By doing this, the total bits consumption to encode the differential indices can be reduced.

Advantageous Effects of Invention

By adopting Huffman codes which consume fewer bits, the total bits consumption to encode the differential indices can be reduced.

BRIEF DESCRIPTION OF DRAWINGS

FIG. 2 shows the codebook for norm factors quantization;

FIG. 5 shows the framework which adopts this invention;

FIGS. 6A and 6B show examples of predefined Huffman tables;

DESCRIPTION OF EMBODIMENTS

The main principle of the invention is described in this section with the aid of FIG. 5 to FIG. 12. Those who are skilled in the art will be able to modify and adapt this invention without deviating from the spirit of the invention. Illustrations are provided to facilitate explanation.

Embodiment 1

Figures 5, 6A:
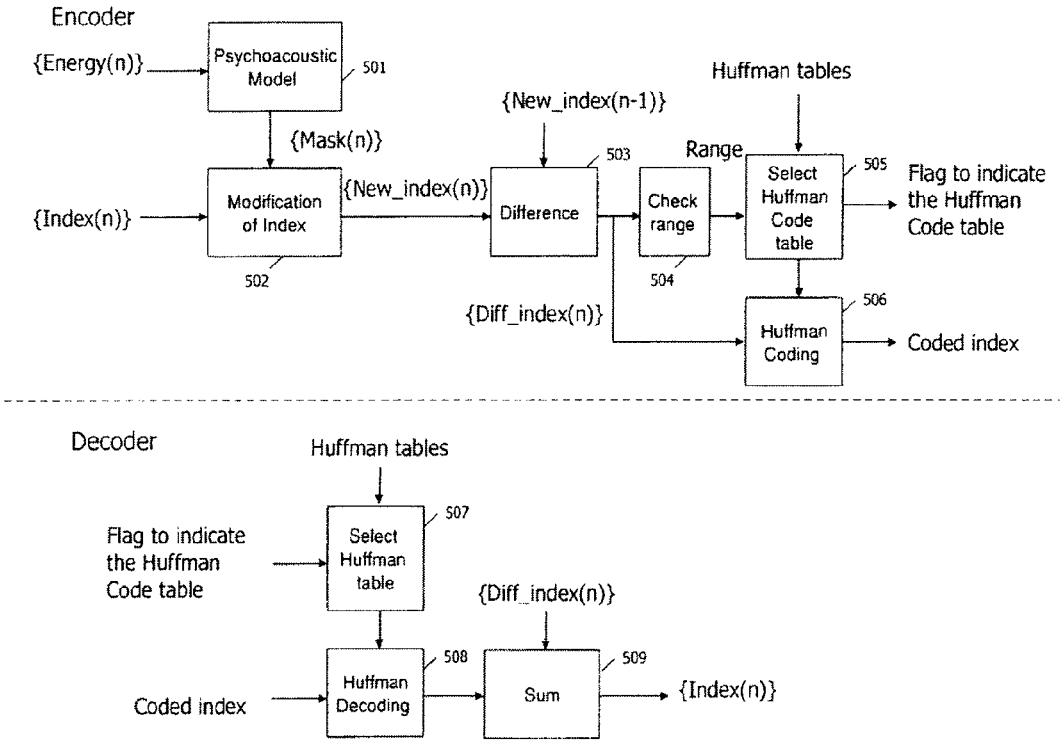

FIG. 5 illustrates the invented codec, which comprises an encoder and a decoder that apply the invented scheme on Huffman coding.

In the encoder illustrated in FIG. 5, the energies of the sub bands are processed by the psychoacoustic modelling (501) to derive the masking threshold Mask(n). According to the derived Mask(n), the quantization indices of the norm factors for the sub bands whose quantization errors are below the masking threshold are modified (502) so that the range of the differential indices can be smaller.

The differential indices for the modified indices are calculated according to the equation below:

[2]

$$\text{Diff_index}(n)=\text{New_index}(n)-\text{New_index}(n-1)+15 \quad \text{for } n\in[1,43] \qquad \text{(Equation 2)}$$

The range of the differential indices for Huffman coding is identified as shown in the equation below (504).

[3]

$$\text{Range}=[\text{Min}(\text{Diff_index}(n),\text{Max}(\text{Diff_index}(n))] \qquad \text{(Equation 3)}$$

According to the value of the range, the Huffman table which is designed for the specific range among a set of predefined Huffman table is selected (505) for encoding of the differential indices (506). As example, if among all the differential indices for the input frame, the minimum value is 12, and the maximum value is 18, then the Range=[12,18]. The Huffman table designed for [12,18] are selected as the Huffman table for encoding.

The set of predefined Huffman tables are designed (detail will be explained in later part) and arranged according to the range of the differential indices. The flag signal to indicate the selected Huffman table and the coded indices are transmitted to the decoder side.

Another method for selection of Huffman table is to calculate all the bits consumption using every Huffman table, then select the Huffman table which consumes fewest bits.

As example, a set of 4 predefined Huffman tables are shown in FIGS. 6A and 6B. In this example, there are 4 predefined Huffman tables, covered range of [13,17], [12, 18], [11,19] and [10,20] correspondingly. Table 6.1 shows the flag signal and corresponding range for Huffman table. Table 6.2 shows the Huffman codes for all the values in the range of [13,17]. Table 6.3 shows the Huffman codes for all the values in the range of [12,18]. Table 6.4 shows the Huffman codes for all the values in the range of [11,19]. Table 6.5 shows the Huffman codes for all the values in the range of [10,20].

Figure 1:
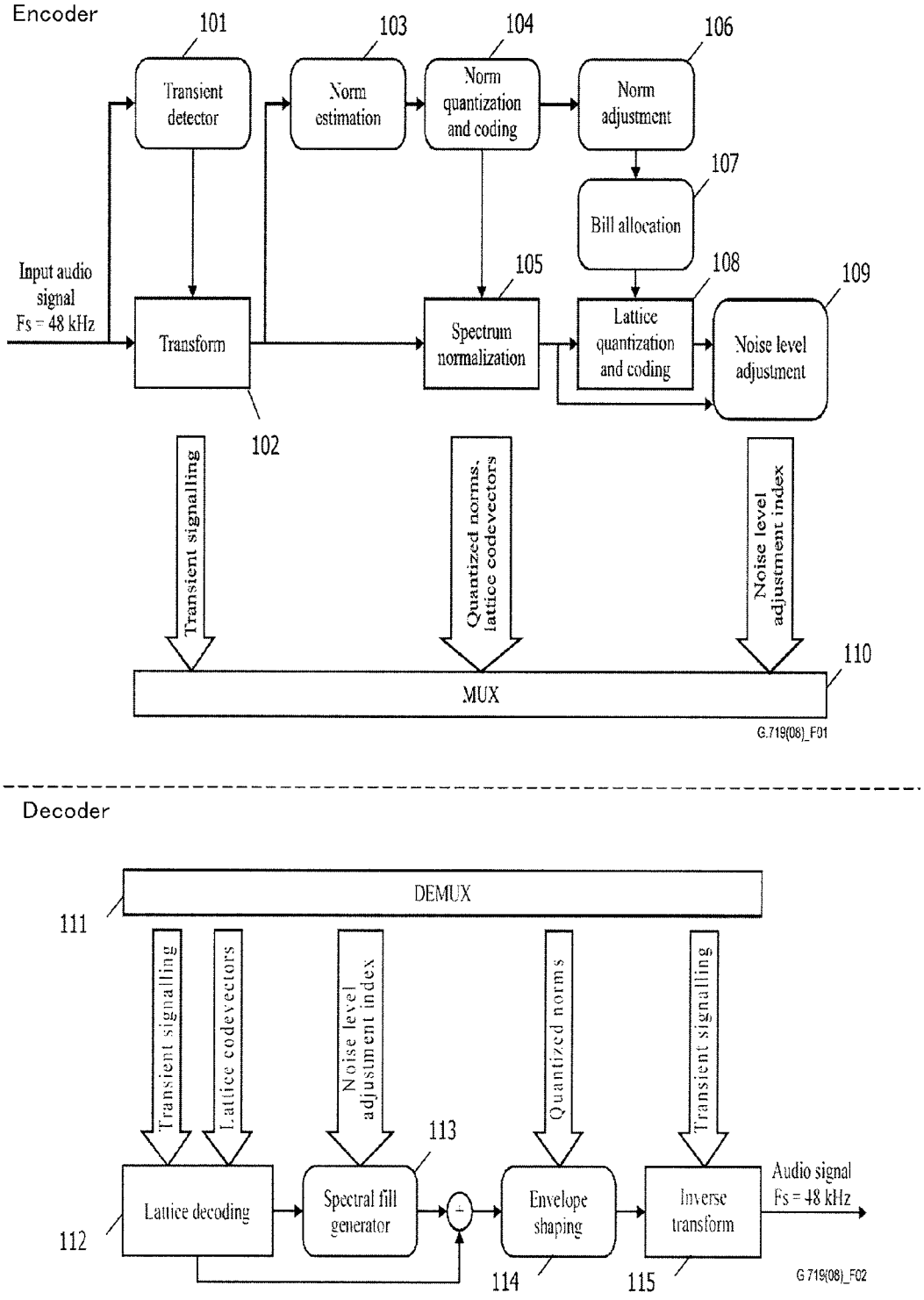
FIG. 1 illustrates the framework of ITU-T G.719.
Figures 3, 4:
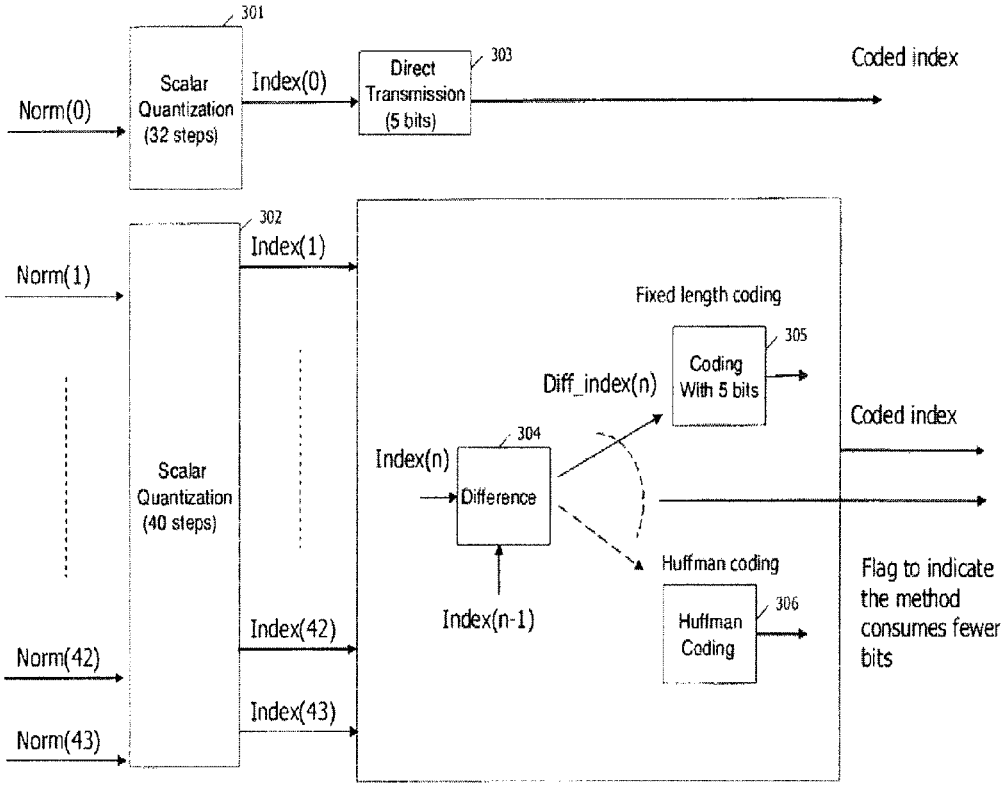
FIG. 3 illustrates the process of norm factors quantization and coding.
FIG. 4 shows the Huffman table used for norm factors indices encoding.

Comparing the Huffman code length in FIGS. 6A and 6B with the original Huffman table shown in FIG. 4, it can be seen that the Huffman code length for the same values consumes fewer bits. It explains how the bits are saved.

In the decoder illustrated in FIG. 5, according to the flag signal, the corresponding Huffman table is selected (507) for decoding of the differential indices (508). The differential indices are used to reconstruct the norm factors quantization indices according to the equation below:

[4]

$$\text{Diff_index}(n)=\text{Index}(n)+\text{Index}(n-1)-15 \text{ for } n\epsilon[1,43] \quad \text{(Equation 4)}$$

Figure 7:
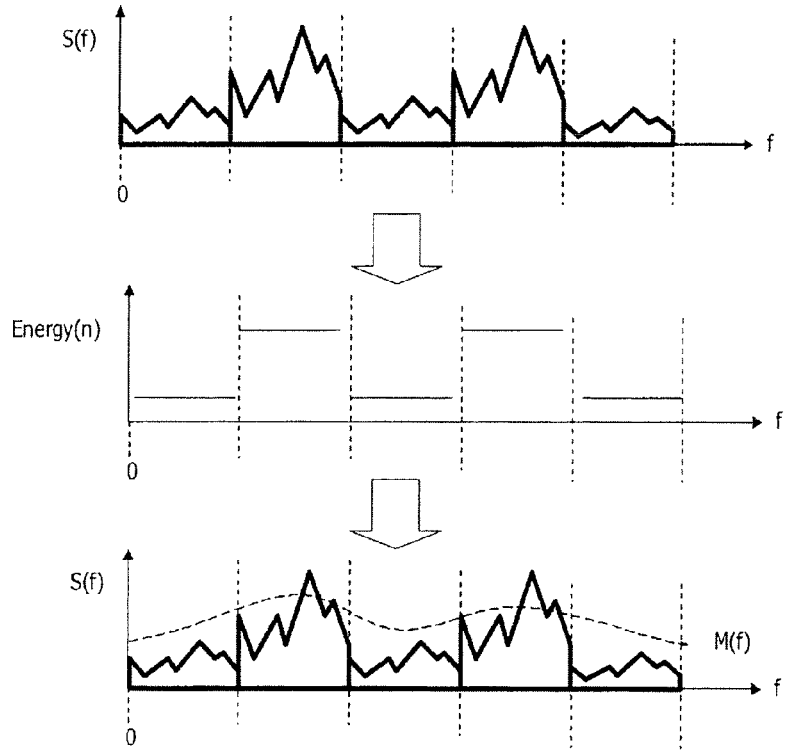
FIG. 7 illustrates the derivation of the masking curve.

FIG. 7 illustrates the derivation of the masking curve of the input signal. Firstly, the energies of the sub bands are calculated, and with these energies and masking curve of the input signal are derived. The masking curve derivation can utilize some prior art existing technologies such as the masking curve derivation method in MPEG AAC codec.

Figure 8:
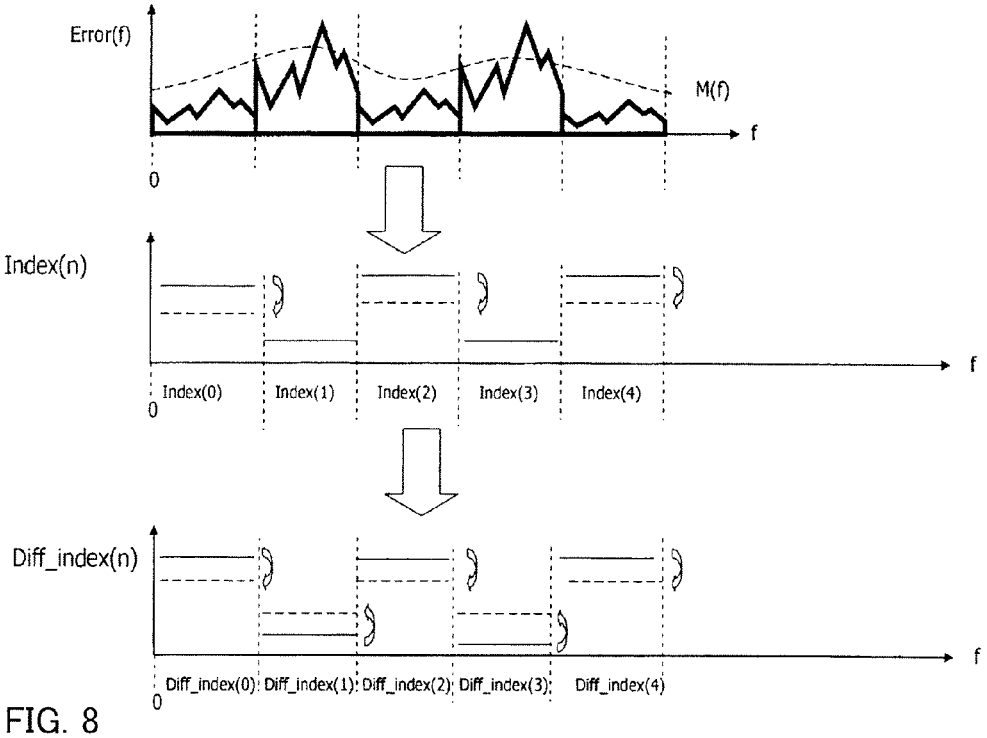
FIG. 8 illustrates how the range of the differential indices be narrowed down.

FIG. 8 illustrates how the range of the differential indices is narrowed down. Firstly, the comparison is done between the masking threshold and the sub band quantization error energy. For the sub bands whose quantization errors energy are below the masking threshold, their indices are modified to a value which is closer to the neighbouring sub band, but the modification is ensured that the corresponding quantization error energy does not exceed the masking threshold, so that sound quality is not affected. After the modification, the range of the indices can be narrowed down. It is explained as below.

As shown in FIG. 8, for sub bands 0, 2 and 4, because their quantization error energies are below the masking threshold, their indices are modified to be closer to their neighbouring indices.

Figure 9:
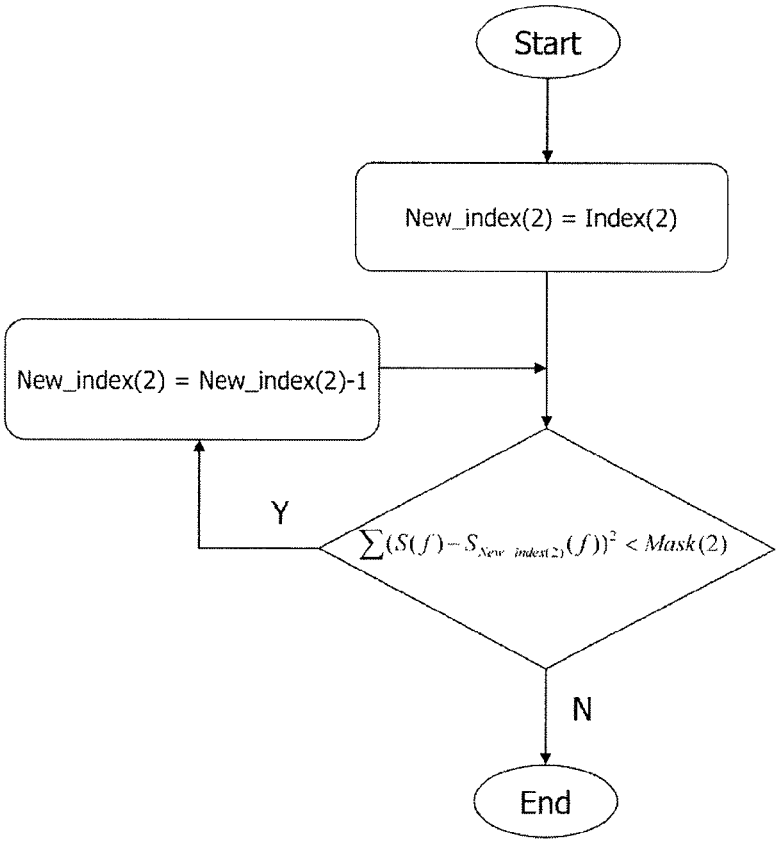
FIG. 9 shows a flowchart of how the modification of the indices is done.

The modification of the indices can be done as below (using sub band 2 as example). As shown in FIG. 2, large index is corresponding to smaller energy, and then Index(1) is smaller than Index(2). The modification of Index(2) is actually to decrease its value. It can be done as shown in FIG. 9.

For sub bands 1 and 3, because their energies are above the masking threshold, their indices are not changed. Then the differential indices are closer to the centre. Using sub band 1 as example:

[5]

$$\text{Diff_index}(1)=\text{Index}(1)-\text{Index}(0)+15 \text{ for } n\epsilon[1,43] \quad \text{(Equation 5)}$$

[6]

$$\text{New_diff_index}(1)=\text{New_index}(1)-\text{New_index}(0)+15 \text{ for } n\epsilon[1,43] \quad \text{(Equation 6)}$$

[7]

$$\because \text{New_index}(1)-\text{New_index}(0)<\text{Index}(1)-\text{Index}(0)$$

$$\therefore \text{New_diff_index}(1)-15<\text{Diff_index}(1)-15 \quad \text{(Equation 7)}$$

Figure 10:
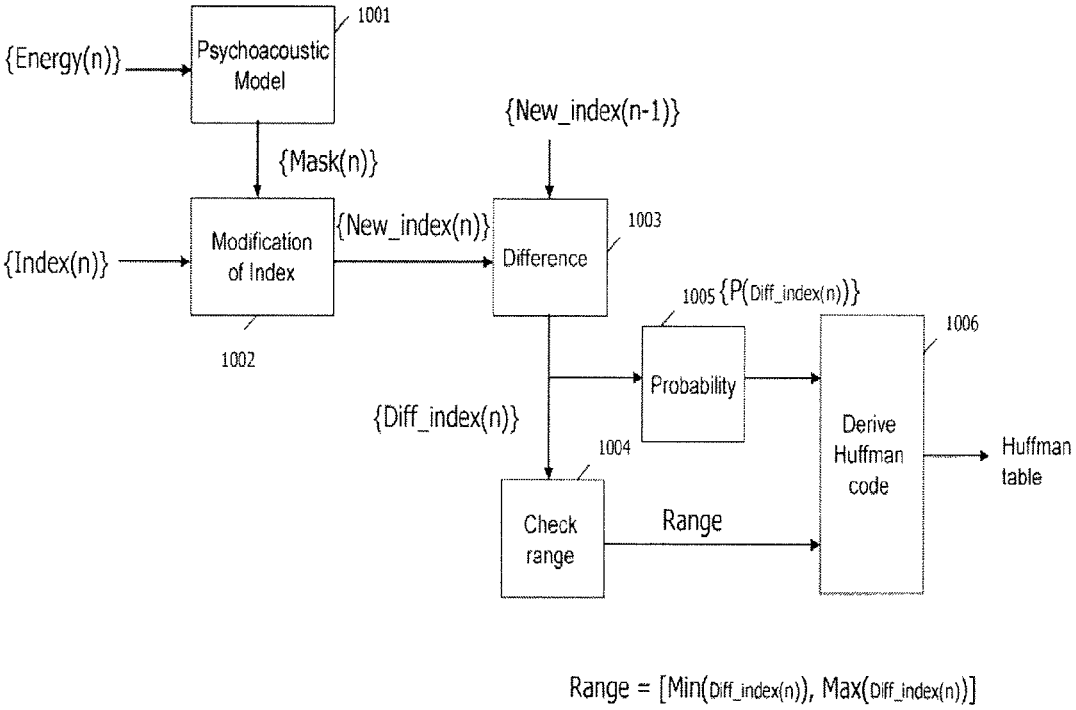
FIG. 10 illustrates how the Huffman tables can be designed.

In this invention, the design of the Huffman table can be done offline with a large input sequence database. The process is illustrated in FIG. 10.

The energies of the sub bands processed by the psychoacoustic modelling (1001) to derive the masked threshold Mask(n). According to the derived Mask(n), the quantization indices of the norm factors for the sub bands whose quantization errors energy are below the masking threshold are modified (1002) so that the range of the differential indices can be smaller.

The differential indices for the modified indices are calculated (1003).

The range of the differential indices for Huffman coding is identified (1004). For each value of range, all the input signal which have the same range will be gathered and the probability distribution of each value of the differential index within the range is calculated.

For each value of range, one Huffman table is designed according to the probability. Some traditional Huffman table design methods can be used here to design the Huffman table.

Embodiment 2

In this embodiment, a method which can maintain the bits saving, but to restore the differential indices to a value closer to the original value is introduced.

Figure 11:
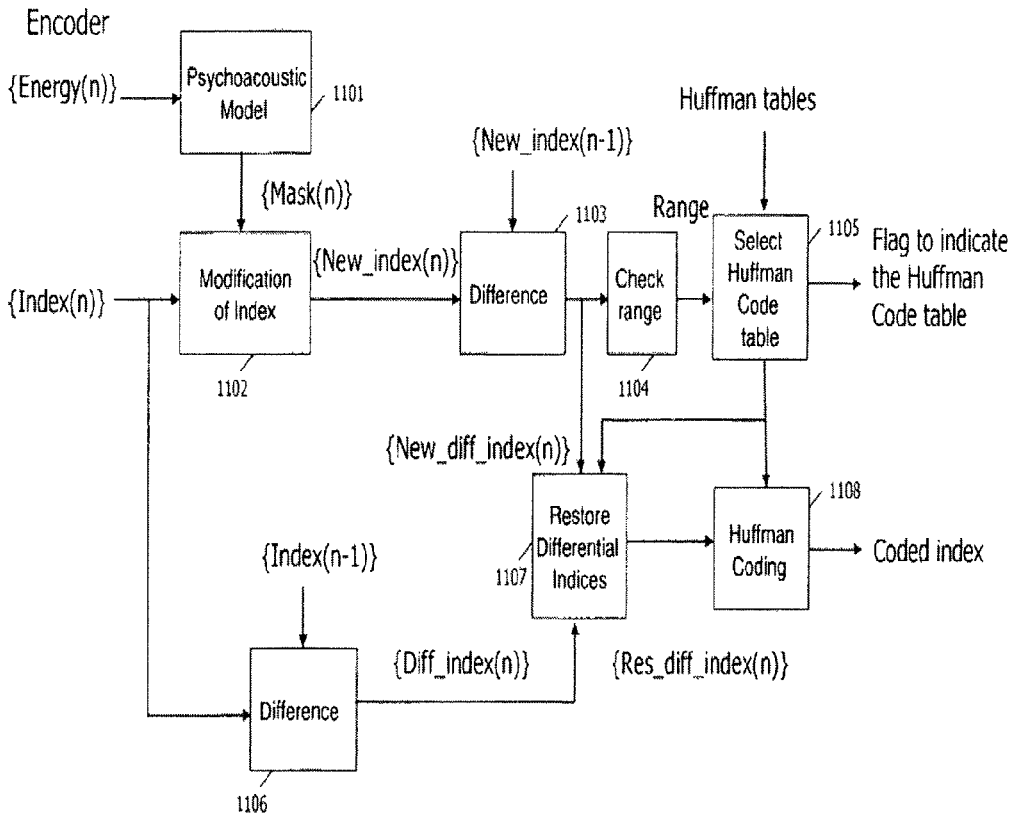
FIG. 11 illustrates the framework of embodiment 2 of this invention.

As shown in FIG. 11, after the Huffman table is selected in 1105, the differential indices are calculated between the original quantization indices. The original differential indices and new differential indices are compared whether they consume same bits in the selected Huffman table.

If they consume same number of hits in the selected Huffman table, the modified differential indices are restored to the original differential indices. If they don't consume same number of bits, the code words in the Huffman table which is closest to the original differential indices and consumes same number of bits are selected as the restored differential indices.

The merits of this embodiment are quantization error of the norm factor can be smaller while the bits consumption is the same as the embodiment 1.

Embodiment 3

In this embodiment, a method which avoids using of the psychoacoustic model but only use some energy ratio threshold is introduced.

Figure 12:
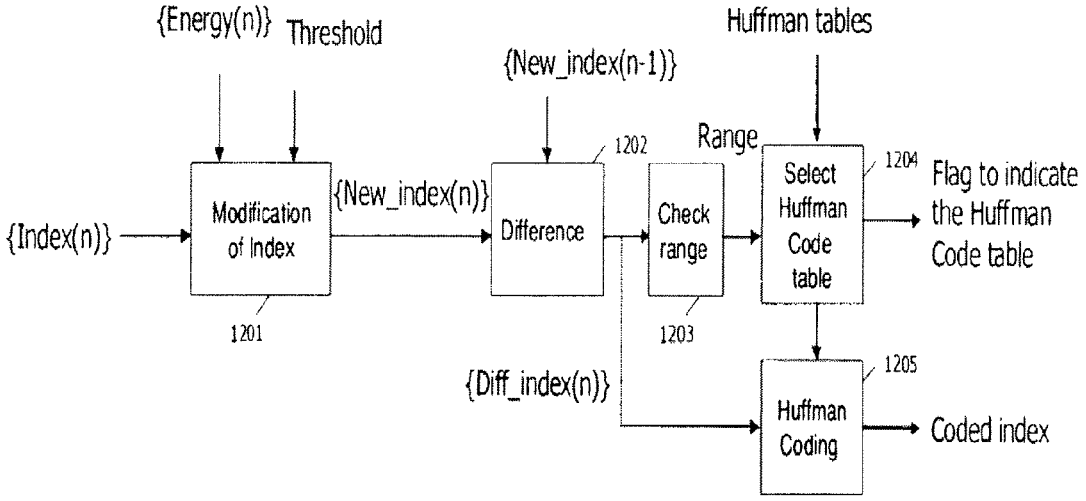
FIG. 12 illustrates the framework of embodiment 3 of this invention.

As shown in FIG. 12, instead of using the psychoacoustic model to derive the masking threshold. The energies of the sub bands and a predefined energy ratio threshold are used to determine whether to modify the quantization index of the specific sub band (1201). As shown in the equation below, if the energy ratio between current sub band and neighbouring sub band is less than threshold, then current sub band is considered as not so important, then the quantization index of the current sub band can be modified.

[8]

$$\text{Energy}(n)/\text{Energy}(n-1)<\text{Threshold} \;\&\&\; \text{Energy}(n)/\text{Energy}(n+1)<\text{Threshold} \quad \text{(Equation 8)}$$

The modification of the quantization index can be done as shown in the equation below:

[9]

$$\left(\frac{NF_{new_index(n)}}{NF_{Index(n)}}\right)^2 = \text{Min}(\text{Energy}(n-1), \text{Energy}(n+1)) * \text{Threshold}/\text{Energy}(n) \quad \text{(Equation 9)}$$

$$\Rightarrow NF_{new_index(n)} = \sqrt{\text{Min}(\text{Energy}(n-1), \text{Energy}(n+1)) * \text{Threshold}/\text{Energy}(n)} * NF_{Index(n)}$$

where, $NF_{NEW_index(n)}$ means the decoded norm factor for sub band n using modified quantization index $NF_{Index(n)}$ means the decoded norm factor for sub band nusing the original quantization index
Energy(n−1) means the energy for sub band n−1
Energy(n) means the energy for sub band n
Energy(n+1) means the energy for sub band n+1

The merit of this embodiment is the very complex and high complexity psychoacoustic modelling can be avoided.

Embodiment 4

In this embodiment, a method which narrows down the range of the differential indices while being able to perfectly reconstruct the differential indices is introduced.

Figure 13:
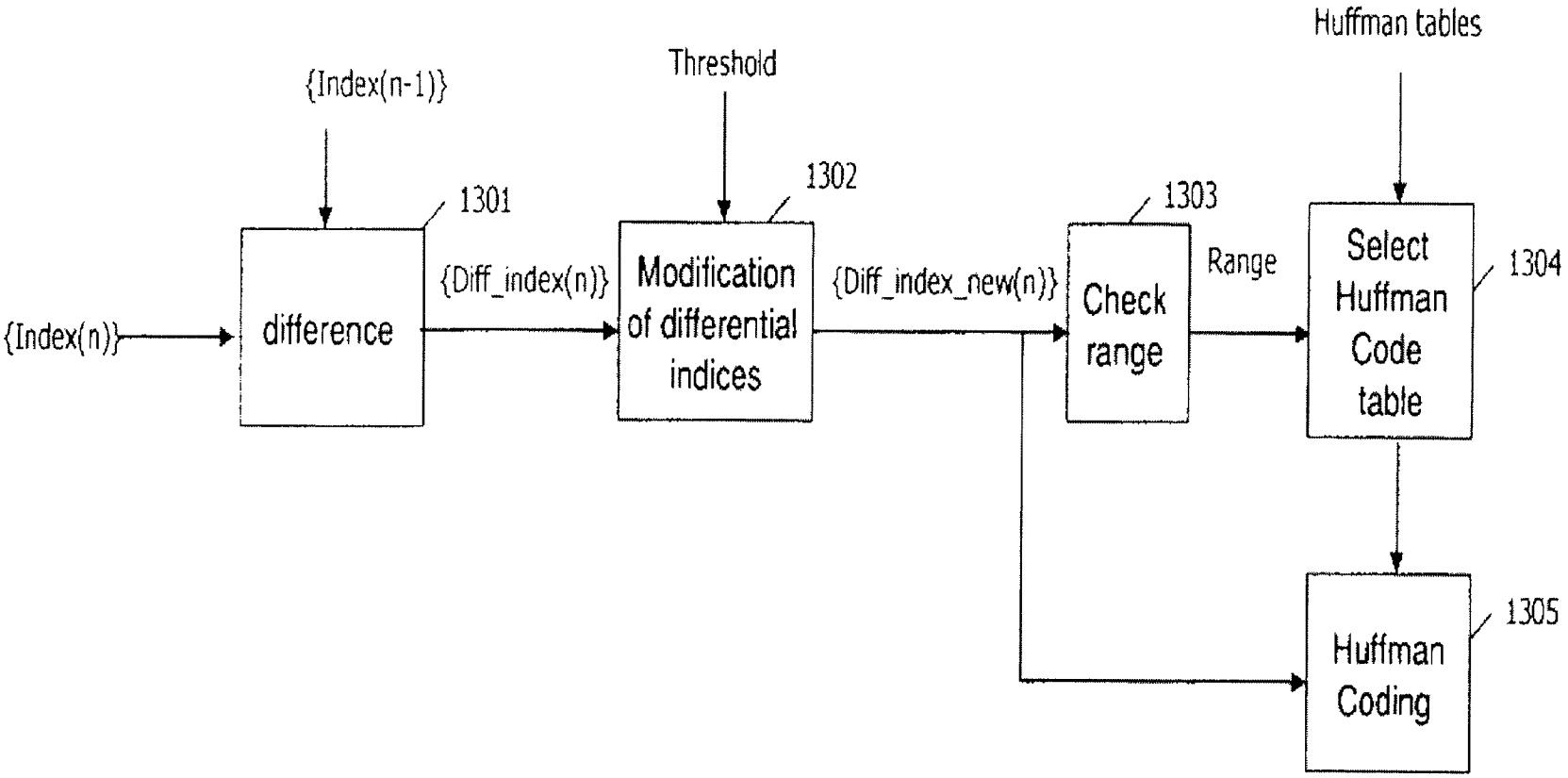
FIG. 13 illustrates the encoder of embodiment 4 of this invention.

As shown in FIG. 13, the differential indices are derived from the original quantization indices (1301) according to the equation below:

$$\text{Diff_index}(n)=\text{Index}(n)-\text{Index}(n-1)+15 \quad \text{(Equation 10)}$$

where,
Diff_index(n) means differential index for sub band n
Index(n) means the quantization index for sub band n
Index(n−1) means the quantization index for sub band n−1

In order to reduce the range of the differential indices, a module is implemented to modify values of some differential indices (1302).

The modification is done according to the value of the differential index for the preceding sub band and a threshold.

One way to modify the differential index (when n≥1) can be done as shown in the equation below, the first differential index would not be modified so as to achieve perfect reconstruction in decoder side:

[11]

if Diff_index($n$−1)>(15+Threshold),

Diff_index_new($n$)=Duff_index($n$)+Diff_index($n$−1)−(15+Threshold); else if Diff_index($n$−1)<(15−Threshold), Diff_index_new($n$)=Duff_index($n$)+Diff_index($n$−1)−(15−Threshold); otherwise Diff_index_new($n$)=Diff_index($n$); (Equation 11)

where,
n≥1;
Diff_index(n) means differential index for sub band n;
Diff_index(n−1) means differential index for sub band n−1;
Diff_index_new(n) means the new differential index for sub band n;
Threshold means the value to examine whether to make the modification of the differential index:

The reason why this modification can reduce the range of the differential indices is explained as following: for audio/speech signal, it is true that the energy fluctuates from one frequency band to another frequency band. However, it is observed that, there is normally no abrupt change in energy from neighboring frequency bands. The energy gradually increases or decreases from one frequency band to another frequency band. The norm factors which represent the energy also gradually changes. The norm factor quantization indices would also gradually change, and then the differential indices would vary in a small range.

The abrupt energy change happens only when some main sound components which have large energy start to show effect in the frequency band or their effect start to diminish. The norm factors which represent the energy also have abrupt change from the preceding frequency band, the norm factor quantization indices would also suddenly increase or decrease by a large value. Then it resulted in a very large or very small differential index.

As an example, assume that there is one main sound component which has large energy in frequency sub band n. While in frequency sub band (n−1) and (n+1), there is no main sound component. Then according to the Huffman table in FIG. 2, Index (n) will have very small value, while Index (n−1) and Index (n+1) will have very large value. Then according to Equation (10), Diff_index(n) is very small (less than (15-Threshold)) and Diff_index(n+1) is very large. If the modification in Equation (11) is conducted, then according to Equation (12) below, the upper boundary of the differential indices can be possibly reduced, therefore the range of the differential indices can be narrowed down.

[12]

∵Diff_index_new($n$−1)<(15−Threshold)

∴Diff_index($n$−1)−(15−Threshold)<0

∵Diff_index_new($n$)=Diff_index($n$)+Diff_index($n$−1)−(15−Threshold);

∴Diff_index_new($n$)<Diff_index($n$) (Equation 12)

Figure 14:
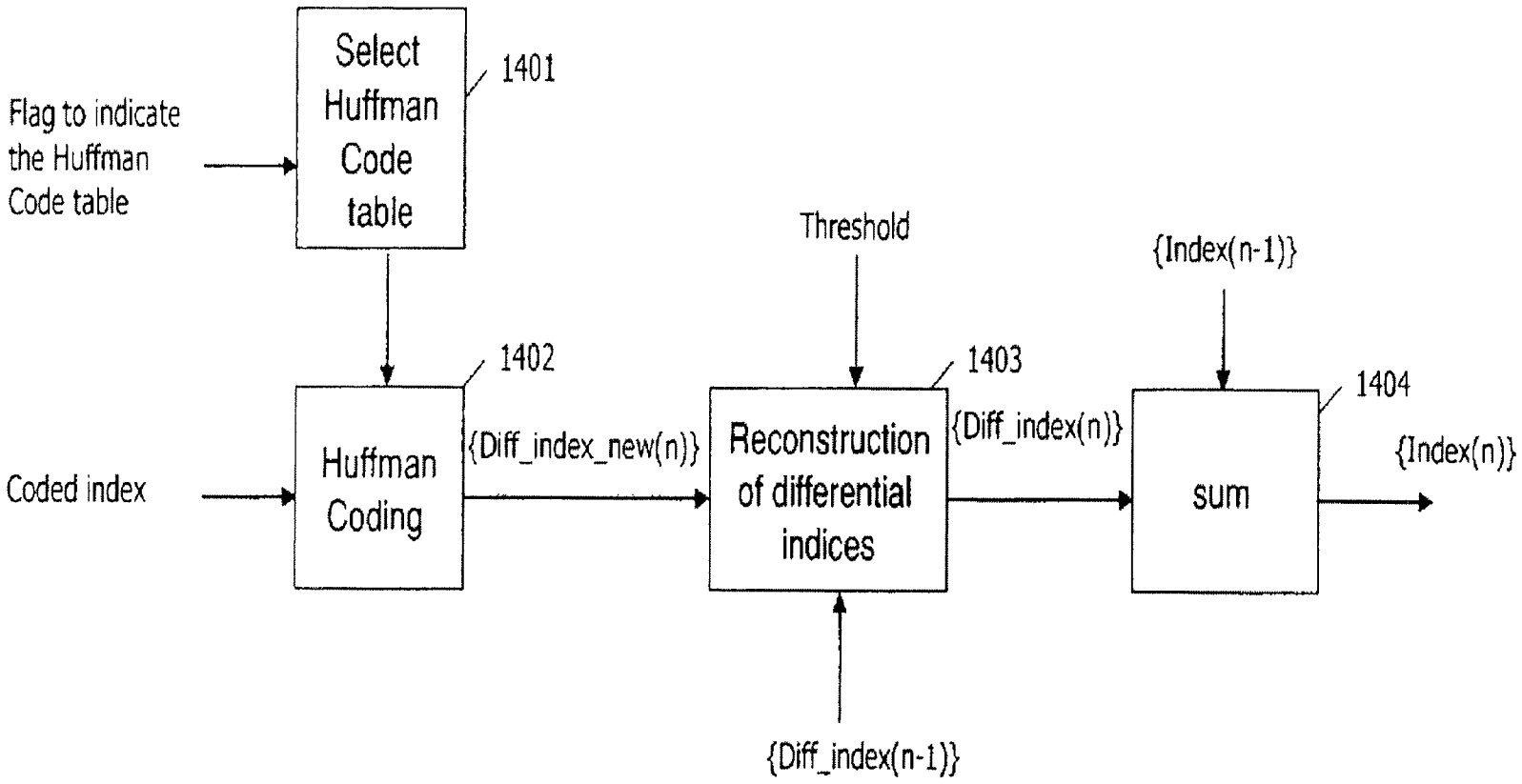
FIG. 14 illustrates the decoder of embodiment 4 of this invention.

As shown in FIG. 14, in decoder side, in order to perfectly reconstruct the differential indices, one module named as 'reconstruction of differential indices' (1403) is implemented. The reconstruction is done according to the value of the differential index for the preceding sub band and a threshold. The threshold in decoder is same as the threshold used in encoder.

The way to reconstruct the differential index(when n≥1), which is corresponding to the modification in encoder, can be done as shown in the equation below, the first differential index would be directly received as it is not modified at encoder side:

[13]

if Diff_index($n$−1)>(15+Threshold),

Diff_index($n$)=Diff_index_new($n$)−Diff_index($n$−1)+(15+Threshold); else if Diff_index($n$−1)<(15−Threshold), Diff_index($n$)=Diff_index_new($n$)−Duff_index($n$−1)+(15−Threshold); otherwise Diff_index($n$)=Diff_index_new($n$); (Equation 13)

where,
Diff_index(n) means differential index for sub band n;
Diff_index(n−1) means differential index for sub band n−1;
Diff_index_new(n) means the new differential index for sub band n:
Threshold means the value to examine whether to reconstruct the differential index:

As shown in the above Equation (11) and Equation (13), whether the modification of a differential index should be done and how much it should be modified is all dependent on the differential index for preceding frequency band. If the differential index for the preceding frequency band can be perfectly reconstructed, then the current differential index can also be perfectly reconstructed.

As shown in the above Equation (11) and Equation (13), the first differential index is not modified at encoder side, it is directly received and can be perfectly reconstructed, then the second differential index can be reconstructed according to the value of the first differential index; then the third differential index, the forth differential index, and so on, by following the same procedure, all the differential indices can be perfectly reconstructed.

The merit of this embodiment is that the range of the differential indices can be reduced, while the differential indices can still be perfectly reconstructed in decoder side. Therefore, the bits efficiency can be improved while retain the bit exactness of the quantization indices.

Further, although cases have been described with the embodiments above where the present invention is configured by hardware, the present invention may be implemented by software in combination with hardware.

Each function block employed in the description of the aforementioned embodiment may typically be implemented as an LSI constituted by an integrated circuit. These may be individual chips or partially or entirely contained on a single chip. "LSI" is adopted here but this may also be referred to as "IC," "system LSI," "super LSI" or "ultra LSI" depending on differing extents of integration.

Further, the method of circuit integration is not limited to LSI's, and implementation using dedicated circuitry or general purpose processors is also possible. After LSI manufacture, utilization of an FPGA (Field Programmable Gate Array) or a reconfigurable processor where connections and settings of circuit cells within an LSI can be reconfigured is also possible.

Further, if integrated circuit technology comes out to replace LSI's as a result of the advancement of semiconductor technology or a derivative other technology, it is naturally also possible to carry out function block integration using this technology. Application of biotechnology is also possible.

The disclosure of Japanese Patent Applications No. 2011-94295, filed on Apr. 20, 2011 and No. 2011-133432, filed on Jun. 15, 2011, including the specification, drawings and abstract is incorporated herein by reference in its entirety.

INDUSTRIAL APPLICABILITY

The encoding apparatus, decoding apparatus and encoding and decoding methods according to the present invention are applicable to a wireless communication terminal apparatus, base station apparatus in a mobile communication system, tele-conference terminal apparatus, video conference terminal apparatus and voice over internet protocol (VOIP) terminal apparatus.

REFERENCE NOTATIONS LIST

101 Transient detector
102 Transform
103 Norm estimation
104 Norm quantization and coding
105 Spectrum normalization
106 Norm adjustment
107 Bit allocation
108 Lattice quantization and coding
109 Noise level adjustment
110 Multiplex
111 Demultiplex
112 Lattice decoding
113 Spectral fill generator
114 Envelope shaping
115 Inverse transform
301 Scalar Quantization (32 steps)
302 Scalar Quantization (40 steps)
303 Direct Transmission (5 bits)
304 Difference
305 Fixed length coding
306 Huffman coding
501 Psychoacoustic model
502 Modification of index
503 Difference
504 Check range
505 Select Huffman code table
506 Huffman coding
507 Select Huffman table
508 Huffman decoding
509 Sum
1001 Psychoacoustic model
1002 Modification of index
1003 Difference
1004 Check range
1005 Probability
1006 Derive Huffman code
1101 Psychoacoustic model
1102 Modification of index
1103 Difference
1104 Check range
1105 Select Huffman code table
1106 Difference
1107 Restore differential indices
1108 Huffman coding
1201 Modification of index
1202 Difference
1203 Check range
1204 Select Huffman code table
1205 Huffman coding
1301 Difference
1302 Modification of differential indices
1303 Check range
1304 Select Huffman code table
1305 Huffman coding
1401 Select Huffman code table
1402 Huffman coding
1403 Reconstruction of differential indices
1404 Sum

The invention claimed is:

1. An audio/speech encoding apparatus, comprising:

a memory that stores instructions;

a processor that, when executing the instructions stored in the memory, performs operations including transforming a time domain input audio/speech signal to a frequency spectrum;

dividing the frequency spectrum to a plural of bands;

calculating a level of energies for each band;

quantizing the energies for the each band;

calculating differential indices between an Nth band index and an (N−1)th band index, where N is an integer of 1 or more, the differential index of the Nth band being determined by subtracting the (N−1)th band index from the Nth band index, and adding a range offset;

modifying a range of the differential indices for the Nth band when N is an integer of 2 or more, and replacing the differential index with the modified differential index;

not modifying a range of the differential indices for the Nth band when N is an integer of 1;

encoding the differential indices using a selected Huffman table among a number of predefined Huffman tables; and transmitting the encoded differential indices and a flag signal for indicating the selected Huffman table over a communication network, wherein when the calculated differential index of the (N−1)th band is greater than an upper limit, the processor modifies the differential index for the Nth band, the upper limit including a threshold added with the range offset, and wherein when the calculated differential index of the (N−1)th band is smaller than a lower limit, the processor modifies the differential index for the Nth band, the lower limit including a threshold subtracted from the range offset.

2. The audio/speech encoding apparatus according to claim 1, wherein the processor selects a Huffman table which was designed based on a minimum value and a maximum value of the differential indices.

3. The audio/speech encoding apparatus according to claim 1, wherein the processor selects a Huffman table which consumes the fewest bits for encoding the differential indices.

4. An audio/speech decoding apparatus, comprising:

a receiver for receiving encoded audio/speech signals transmitted over a communication channel from an audio/speech encoding apparatus;

a memory that stores instructions;

a processor that, when executing the instructions stored in the memory, performs operations including selecting a Huffman table according to a flag signal to indicate the selected Huffman table by the audio/speech encoding apparatus;

decoding differential indices between an Nth band index and an (N−1)th band index, where N is an integer of 1 or more, received by the audio/speech encoding apparatus, using the selected Huffman table, the differential index of the Nth band being determined by subtracting the (N−1)th band index from the Nth band index and adding a range offset;

reconstructing the Nth differential different index decoded using the selected Huffman table when N is an integer of 2 or more, and replacing the differential index with the reconstructed differential index;

not replacing a range of the differential indices for the Nth band when N is an integer of 1;

calculating quantization indices using the decoded differential indices;

dequantizing energies for each band; and transforming a decoded spectrum, which is generated using the energies for each band in a frequency domain to a time domain signal outputting as audio/speech signals, wherein when the decoded differential index of the (N−1)th band is greater than an upper limit, the processor reconstructs the differential index for the Nth band, the upper limit including a threshold added with the range offset, and wherein when the decoded differential index of the (N−1)th band is smaller than a lower limit, the processor reconstructs the differential index for the Nth band, the lower limit including a threshold subtracted from the range offset.

5. An audio/speech encoding method, comprising:

transforming, by a transformer, a time domain input signal to a frequency spectrum;

dividing the frequency spectrum to a plural of bands;

calculating a level of energies for each band;

quantizing the energies for the each band;

calculating differential indices between an Nth band index and an (N−1)th band index, where N is an integer of 1 or more, the differential index of the Nth band being determined by subtracting the (N−1)th band index from the Nth band index and adding a range offset;

modifying a range of the differential indices for the Nth band when N is an integer of 2 or more, and replacing the differential index with the modified differential index;

not modifying a range of the differential indices for the Nth band when N is an integer of 1;

encoding the differential indices using a selected Huffman table among a number of predefined Huffman tables; and transmitting the encoded differential indices and a flag signal for indicating the selected Huffman table, wherein when the calculated differential index of the (N−1)th band is greater than an upper limit, the differential index for the Nth band is modified, the upper limit including a threshold added with the range offset, and wherein when the calculated differential index of the (N−1)th band is smaller than a lower limit, a differential index for the Nth band is modified, the lower limit including a threshold subtracted from the range offset.

6. An audio/speech decoding method, comprising:

receiving encoded audio/speech signals transmitted over a communication channel from an audio/speech encoding apparatus;

selecting a Huffman table according to a flag signal to indicate the selected Huffman table by the audio/speech encoding apparatus;

decoding differential indices between an Nth band index and an (N−1)th band index, where N is an integer of 1 or more, received by the audio/speech encoding apparatus, using the selected Huffman table, the differential index of the Nth band being determined by subtracting the (N−1)th band index from the Nth band index and adding a range offset;

reconstructing the Nth differential index decoded using the selected Huffman table when N is an integer of 2 or more, and replacing the differential index with the reconstructed differential index;

not replacing a range of the differential indices for the Nth band when N is an integer of 1;

calculating quantization indices using the decoded differential indices;

dequantizing, by a dequantizer, energies for each band; and transforming a decoded spectrum which is generated using the energies for each band in a frequency domain to a time domain signal outputting as audio/speech signals, wherein when the differential index of the (N−1)th band is greater than an upper limit, a differential index for the Nth band is reconstructed, the upper limit including a threshold added with the range offset, and wherein when the decoded differential index of the (N−1)th band is smaller than a lower limit, the differential index for the Nth band is reconstructed, the lower limit including a threshold subtracted from the range offset.

* * * * *